US008720752B2

(12) United States Patent
Huang et al.

(10) Patent No.: US 8,720,752 B2
(45) Date of Patent: May 13, 2014

(54) CARRYING ASSEMBLY AND ELECTRONIC DEVICE USING THE SAME

(75) Inventors: Jr-Hung Huang, Taipei (TW); Ho-Ching Huang, Taipei (TW); Wen-Cheng Tsai, Taipei (TW)

(73) Assignee: Pegatron Corporation, Taipei (TW)

( * ) Notice: Subject to any disclaimer, the term of this patent is extended or adjusted under 35 U.S.C. 154(b) by 233 days.

(21) Appl. No.: 13/349,569

(22) Filed: Jan. 13, 2012

(65) Prior Publication Data

US 2012/0180263 A1 Jul. 19, 2012

(30) Foreign Application Priority Data

Jan. 14, 2011 (TW) ..... 100101472 A

(51) Int. Cl.
*B25G 3/18* (2006.01)
*A45F 5/10* (2006.01)

(52) U.S. Cl.
USPC ..... 224/218; 224/219; 224/221

(58) Field of Classification Search
USPC ..... 224/217, 218, 221, 255, 256; 403/353; 248/197, 466, 475.1, 476, 489, 495, 248/496, 176.1, 317
See application file for complete search history.

(56) References Cited

U.S. PATENT DOCUMENTS 5,597,189 A * 1/1997 Barbee, Sr. ..... 294/25

FOREIGN PATENT DOCUMENTS

| | | |
|---|---|---|
| CN | 101281412 A | 10/2008 |
| CN | 101424957 A | 5/2009 |
| TW | 261251 | 10/1995 |
| TW | M339501 | 9/2008 |

* cited by examiner

*Primary Examiner* — Adam Waggenspack
(74) *Attorney, Agent, or Firm* — CKC & Partners Co., Ltd.

(57) ABSTRACT

A carrying assembly which may be detachably secured to a housing of an electronic device is disclosed. The carrying assembly includes a body and a positioning member. The body includes an opening and a first positioning portion positioned on a first surface of the body. The positioning member includes a second positioning portion and a top portion connected thereto. The second positioning portion detachably engages with the first positioning portion. The top portion protrudes from a second surface of the body through the opening, the second surface being opposite the first surface. When the top portion is pressed, the second positioning portion is separated from the first positioning portion, and a relative position between the body and the positioning member may be adjusted, thereby adjusting the length of the belt.

16 Claims, 7 Drawing Sheets

CARRYING ASSEMBLY AND ELECTRONIC DEVICE USING THE SAME

RELATED APPLICATIONS

This application claims priority to Taiwan Application Serial Number 100101472, filed Jan. 14, 2011, which is herein incorporated by reference.

BACKGROUND

1. Technical Field

The present disclosure relates to a carrying assembly. More particularly, present disclosure relates to an adjustable length carrying assembly.

2. Description of Related Art

Various types of electronic devices are in use today. Since people may be necessary or desirable to carry some electronic devices, carrying assemblies have been developed to allow for convenient carrying of such electronic devices. For example, carrying assemblies are provided for laptops and tablets.

A shoulder strap-type carrying assembly is a familiar type of carrying assembly. In this type of carrying assembly, a shoulder strap is connected to an electronic device so that a user may carry the electronic device using the shoulder strap.

Another common type of carrying assembly is a handle-type carrying assembly. In this type of carrying assembly, a handle is secured to the electronic device, and a user may carry the electronic device using the handle.

Each of the shoulder strap-type and the handle-type carrying assembly is provided with an adjustable length of the shoulder strap or handle to suit different users. The adjustable shoulder strap or handle is similar to that used in shoulder straps or belts found on backpacks. The adjustable shoulder strap or handle is arranged on the shoulder strap or handle to adjust the carrying length. However, these adjustable shoulder strap and handle have a common drawback in that it is inconvenient to adjust the carrying length when the electronic device is being carried by the carrying assembly.

In view of the above, there exists a need to provide an improved carrying assembly that provides greater convenience and easy use.

SUMMARY

According to one aspect of the present disclosure, there is provided a carrying assembly capable of being detachably secured on a housing of an electronic device.

One embodiment of the carrying assembly comprises a body and a positioning member. The body includes a first positioning portion and an opening. The first positioning portion is positioned on a first surface of the body. The positioning member includes a second positioning portion and a top portion connected the second positioning portion. The second positioning portion is detachably engaged with the first positioning portion. The top portion protrudes from a second surface opposite the first surface of the body through the opening. When the top portion is pressed, the second positioning portion is separated from the first positioning portion so that a relative position of the positioning member with respect to the body may be adjusted. In one embodiment, the first positioning portion is positioned in a region surrounding the opening.

In one embodiment, the top portion is movable along the opening, so that the second positioning portion is detachably engaged with the first positioning portion at a first position relative to the first positioning portion, and when the top portion is pressed, the second positioning portion is separated from the first positioning portion, and capable of being moved to a second position relative to the first positioning portion.

In one embodiment, the carrying assembly further comprises an elastic member secured on the first surface of the body, and the positioning member is positioned between the elastic member and the body. When the top portion is pressed, the second positioning portion is separated from the first positioning portion and thus the elastic member deforms and stores an elastic potential. When the top portion is released, the elastic member releases the elastic potential such that the second positioning portion is engaged with the first positioning portion.

In one embodiment, the elastic member comprises a fixing plate and an elastic piece. The fixing plate is secured on the first surface. One end of the elastic piece is physically connected to the fixing plate, and another end of the elastic piece abuts against the positioning member. In one embodiment, the first positioning portion has a first tooth structure, and the second positioning portion has a second tooth structure. The first tooth structure engages with the second tooth structure.

In one embodiment, the carrying assembly further comprises a belt connected to the positioning member. The body has a slit, and the belt extends from a side of the first surface through the slit to a side of the second surface.

In one embodiment, the carrying assembly further comprises a fastener for securing the carrying assembly to the electronic device, the fastener being disposed on at least one corner of the body.

In one embodiment, the carrying assembly further comprises a ring for connecting to a shoulder strap.

According to one aspect of the present disclosure, there is provided an electronic device. The electronic device includes a housing and a carrying assembly described above which is detachably secured on the housing.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
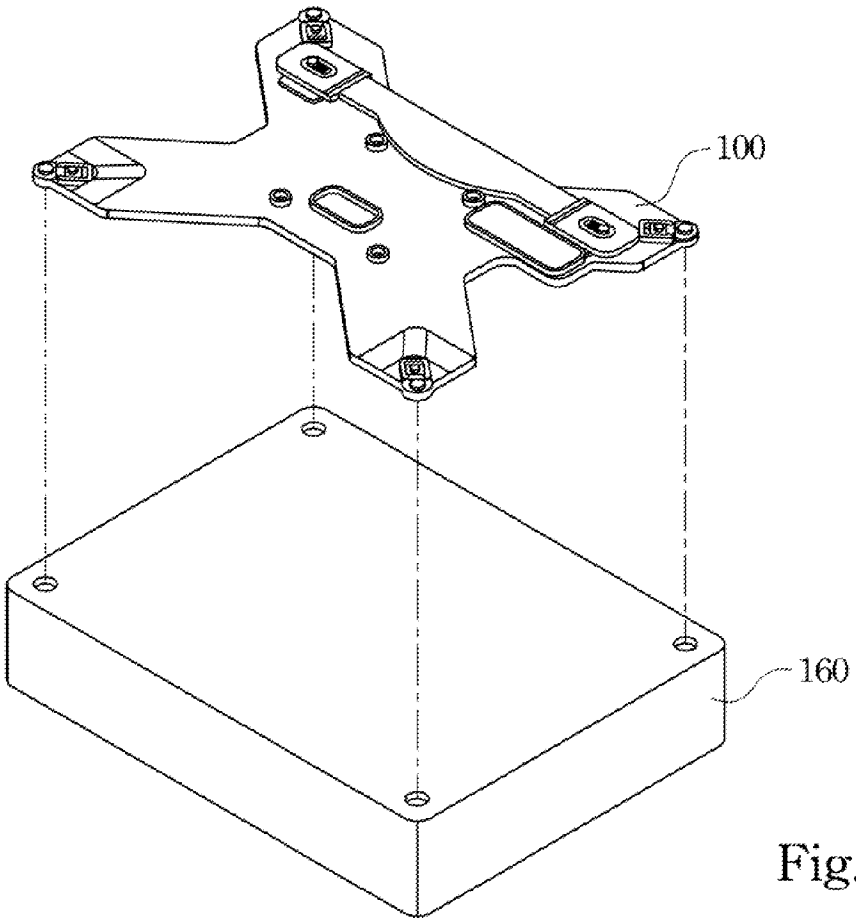
FIG. 1A is a perspective view of a carrying assembly according to one embodiment of the present disclosure, showing the manner in which the carrying assembly may be connected to an electronic device.

Reference will now be made in detail to the present embodiments of the invention, examples of which are showed in the accompanying drawings. Wherever possible, the same reference numbers are used in the drawings and the description to refer to the same or like parts.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1B:
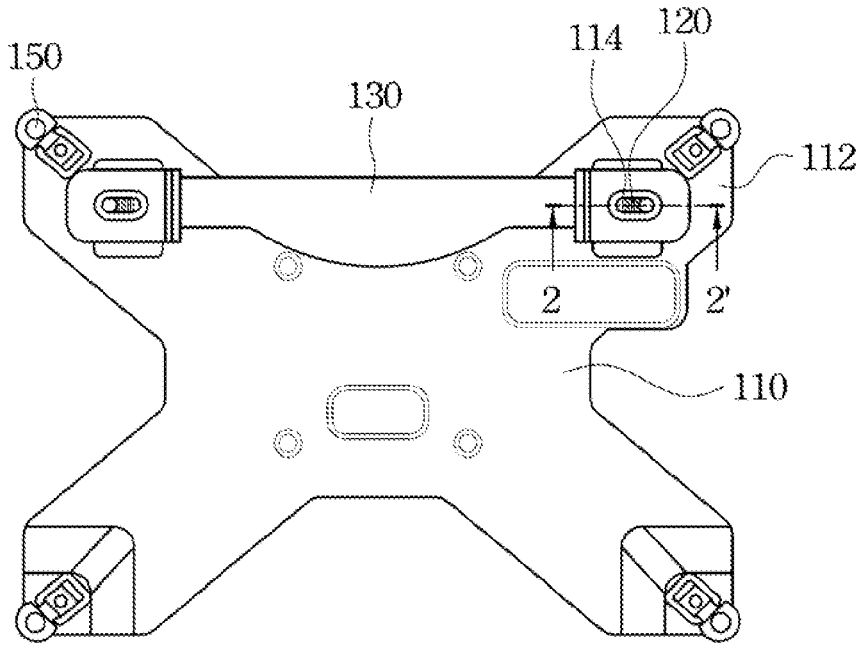
FIG. 1B is a front view of the carrying assembly in FIG. 1A.
Figure 1C:
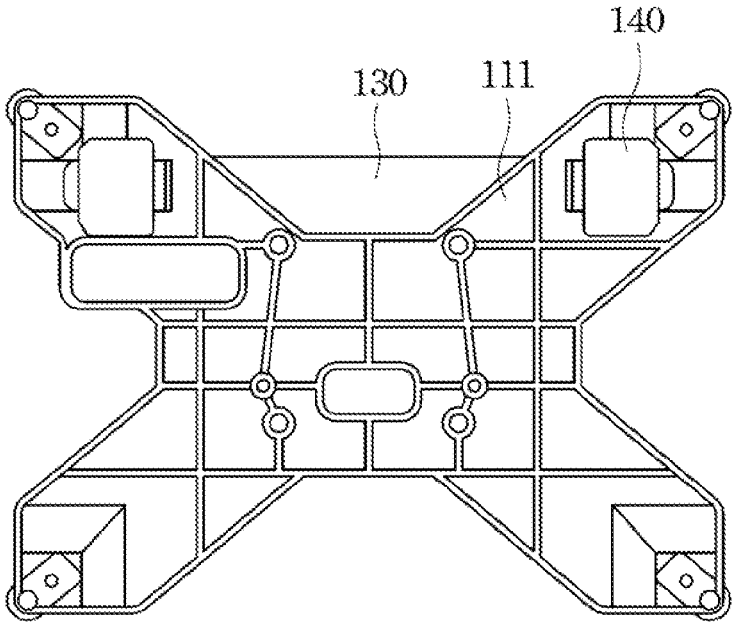
FIG. 1C is a back view of the carrying assembly in FIG. 1A.

Disclosed herein is a carrying assembly for an electronic device. FIG. 1A is a perspective view of a carrying assembly 100 according to one embodiment of the present invention, showing the manner in which the carrying assembly 100 may be connected to an electronic device 160. The carrying assembly 100 may be detachably secured on the housing of the electronic device 160. FIG. 1B is a front view of the carrying assembly 100, and FIG. 1C is a back view of the carrying assembly 100. The carrying assembly 100 includes a body 110, a positioning member 120 and a belt 130. The body 110 has a first surface 111 and a second surface 112 opposite the first surface 111. The electronic device 160 may be secured on the side of the first surface 111, and a user may adjust the position of the positioning member 120 so that the belt 130 is adjusted to a suitable length for the user.

Figure 2A:
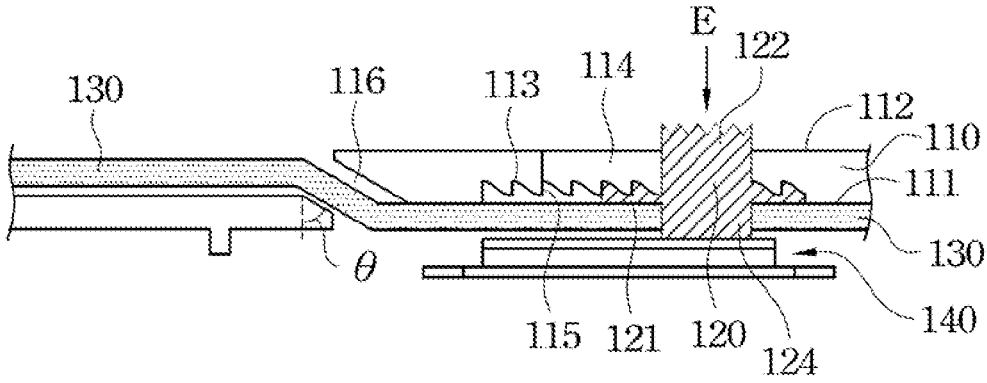
FIG. 2A is cross-sectional view along line 2-2' in FIG. 1B.
Figure 2B:
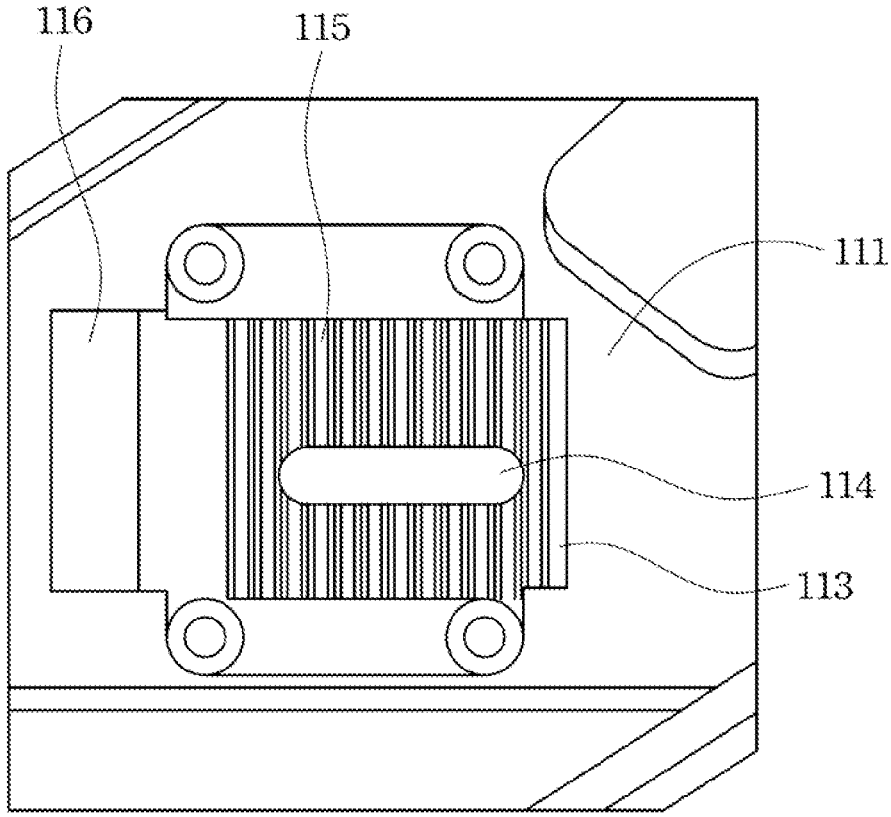
FIG. 2B is a top view showing an opening and a first positioning portion according to one embodiment of the present disclosure.

FIG. 2A is cross-sectional view along line 2-2' in FIG. 1B. Referring to FIG. 2A, the body 110 includes a first positioning portion 113 positioned on the first surface 111. The first positioning portion 113 may be, for example, a tooth surface comprised of a plurality of teeth and a plurality of trenches 115, in which each of the trenches 115 is defined between an adjacent pair of the teeth. In embodiments, the first positioning portion 113 may include a number of teeth that are trianglular, square-shaped or another shape in cross section. The depth of each of the trenches 115 may be, for example, about 3 mm to about 5 mm. In one example, a sidewall of the trenches 115 is perpendicular to the first surface 111. Stated differently, in some embodiments, a sidewall of each of the teeth, adjacent pairs of which respectively define the trenches 115, is perpendicular to the first surface 111. FIG. 2B is a top view showing the first positioning portion 113 according to one embodiment of the present disclosure. When viewed from above as in FIG. 2B, the trenches 115 may be arranged in a manner parallel with each other, and the trenches 115 have a pitch of about 2 mm to about 4 mm.

The body 110 further comprises an opening 114 that extends through the body 110 from the first surface 111 to the second surface 112. FIG. 2B depicts the position of the opening 114 according to one embodiment of the present disclosure. In this embodiment, the opening 114 is located in a region surrounded by the first positioning portion 113, that is, the first positioning portion 113 surrounds the opening 114.

In other embodiments, the body 110 may have two openings (not shown) respectively located at both sides of the first positioning portion 113. Accordingly, both the opening 114 and the first positioning portion 113 are not limited to the shape and the position depicted in FIG. 2B.

Figure 2C:
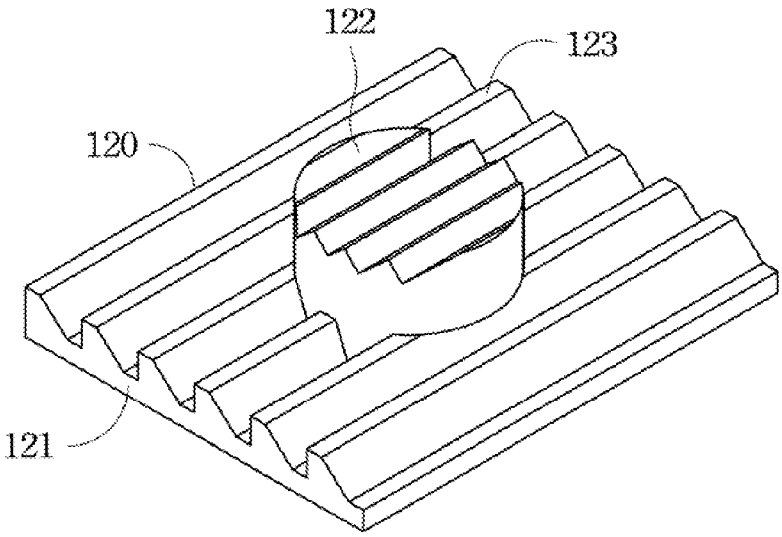
FIG. 2C is a perspective view showing a positioning member according to one embodiment of the present disclosure.

The positioning member 120 includes a second positioning portion 121 which detachably engages with the first positioning portion 113. FIG. 2C is a perspective view illustrating the positioning member 120 according to one embodiment of the present disclosure. The second positioning portion 121 includes a plurality of protrusions 123 having a shape substantially corresponding to the shape of the trenches 115 of the first positioning portion 113. In one example, the first positioning portion 113 and the second positioning portion 121 respectively have first and second tooth structures so that the first positioning portion 113 may be engaged with second positioning portion 121. Accordingly, when the second positioning portion 121 engages with the first positioning portion 113, the positioning member 120 is unable to be moved relative to the first positioning portion 113 in a direction parallel to line 2-2' depicted in FIG. 1B. However, when the second positioning portion 121 is separated from the first positioning portion 113, the positioning member 120 may be moved relative to the first positioning portion 113 in a direction parallel to line 2-2'. In other words, the position of the positioning member 120 relative to the body 110 may be adjusted by separating the second positioning portion 121 from the first positioning portion 113.

The positioning member 120 includes a top portion 122 protruding from the second surface 112 of the body 110 through the opening 114, as depicted in FIG. 2A. In one embodiment, the top portion 122 extends upwards from substantially a center of the second positioning portion 121. The number and the position of the top portion 122 are not limited to those described above. In another embodiment, the positioning member 120 further includes a connecting portion 124. The connecting portion 124 and the top portion 122 are respectively disposed on opposite sides of the second positioning portion 121.

The connecting portion 124 may protrude from a lower surface of the second positioning portion 121, and is connected to the belt 130. In other embodiments, the positioning member 120 may comprise two top portions (not shown) extending from the second positioning portion 121, the body 110 may comprise two openings respectively corresponding to the two top portions, and each of the two top portions may protrude out of the second surface 112 of the body 110 through the corresponding opening.

In the present disclosure, the detachable engagement of the second positioning portion 121 with the first positioning portion 113 is not limited to any particular structure or manner of operation. In one embodiment, the carrying assembly 100 may comprise an elastic member 140 disposed at a side of the first surface 111, and the second positioning portion 121 is arranged between the elastic member 140 and the body 110. The elastic member 140 may apply a force to the positioning member 120 such that the second positioning portion 121 detachably engages with the first positioning portion 113. In other words, when the top portion 122 is pressed, the second positioning portion 121 is separated from the first positioning portion 113 and thus the elastic member 140 deforms and stores an elastic potential. Subsequently, when the top portion 122 is released, the elastic member 140 releases the elastic potential such that the second positioning portion 121 engages with the first positioning portion 113.

Figure 2D:
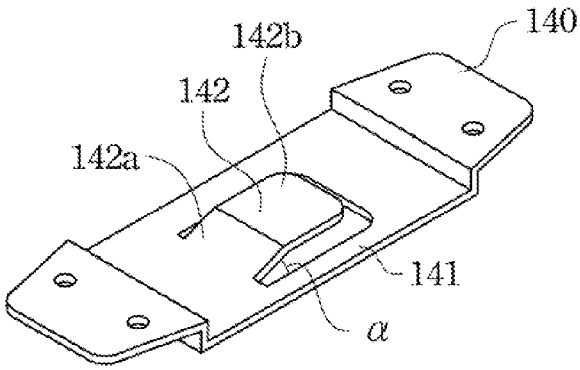
FIG. 2D is a perspective view showing an elastic member according to one embodiment of the present disclosure.

In one embodiment, as depicted in FIG. 2D, the elastic member 140 may comprise a fixing plate 141 and an elastic piece 142. The fixing plate 141 may be secured on the first surface 111 of the body 110. The elastic piece 142 includes an inclined portion 142*a* and a flat portion 142*b*. The inclined portion 142*a* has an end physically connected to the fixing plate 141, and extends from this end in such a manner that an included angle α is formed between the fixing plate 141 and the inclined portion 142*a*. The included angle α may be about 10 degrees to about 20 degrees, for example. The flat portion 142*b* of the elastic piece 142 abuts against the connecting portion 124, and may apply an elastic force such that the second positioning portion 121 is pressed against the first positioning portion 113. In this embodiment, a spacing distance of about 3-5 mm is present between the flat portion 142*b* and the fixing plate 141 in a direction perpendicular to the flat portion 142*b*. Other elastic mechanisms such as spring sets or elastic materials may be employed in the present disclosure. In other embodiments, the second positioning portion 121 may detachably engage with the first positioning portion 113 by a magnetic force. Specifically, the second positioning portion 121 and the first positioning portion 113 may have different magnetic polarities so that the first and the second positioning portions 113, 121 are detachably engaged with each other.

Figure 3A:
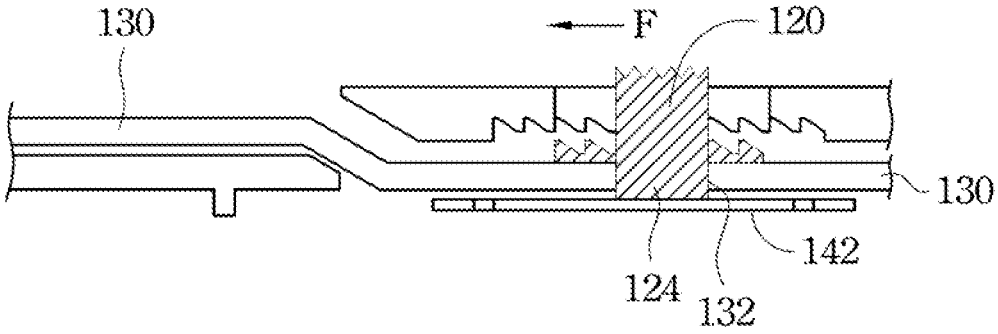
FIG. 3A and FIG. 3B are cross-sectional views along line 2-2' in FIG. 1B, showing the procedure involved in moving a positioning member relative to a first positioning portion.
Figure 3B:
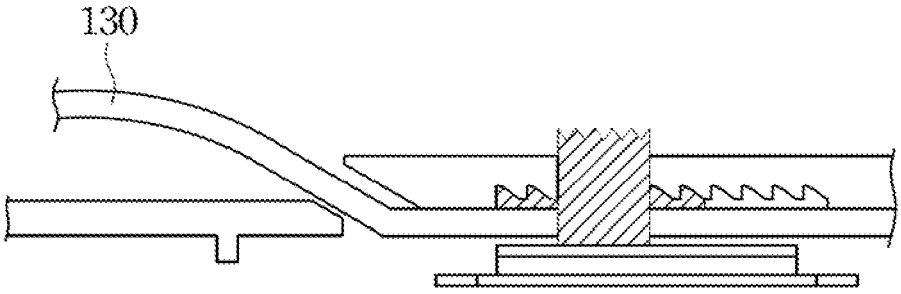

Referring to FIG. 2A, FIG. 3A and FIG. 3B, the procedure associated with the movement of the positioning member 120 relative to the first positioning portion 113 will now be described. FIG. 2A depicts the state in which the positioning member 120 is engaged with the first positioning portion 113. In this state, the positioning member 120 is immovable relative to the first positioning portion 113 in the direction parallel to line 2-2' depicted in FIG. 1B. When it is desired to move the positioning member 120 relative to the first positioning portion 113, a user first presses the top portion 122 of the positioning member 120 in the direction E such that the second positioning portion 121 of the positioning member 120 is separated from the first positioning portion 113. Subsequently, referring to FIG. 3A, the positioning member 120 is pushed along the direction F (or perhaps in the opposite direction) so that the positioning member 120 is moved relative to the first positioning portion 113. Next, as depicted in FIG. 3B, when the positioning member 120 is moved to a desired position, the positioning member 120 is released by the user such that the second positioning portion 121 returns to a state where the first and the second positioning portions 113, 121 are engaged with each other through either the elastic force applied by the elastic member 140 or the magnetic force between the first and the second positioning portions 113, 121.

The belt 130 has an end connected to the positioning member 120. When the positioning member 120 is moved relative to the first positioning portion 113, the belt 130 may be adjusted in length since the belt 130 is moved with the positioning member 120. In one embodiment, the belt 130 has a connecting hole 132 through which the connecting portion 124 extends for abutment against the elastic piece 142, as depicted in FIG. 3A. It is noted that other connecting approaches or mechanisms may be used to connect the belt 130 with the positioning member 120 in the present disclosure.

In one embodiment, with reference to FIGS. 2A and 2B, the body 100 has a slit 116 formed therethrough. The belt 130 extends from the side of the first surface 111 through the slit 116 to the side of the second surface 112. Accordingly, when the positioning member 120 is moved, the length of the belt 130 positioned at the side of second surface 112 may be adjusted, as depicted in FIG. 3B. In other words, the actual length of the belt 130 is not changed, but the loosening or tightening degree of the belt 130 may be adjusted. Therefore, the user may adjust the belt 130 to a desired length by adjusting the position of the positioning member 120. In one example, the slit 116 penetrates through the body 130 at an inclined angle θ of about 10-80 degrees, as depicted in FIG. 2A. In other examples, the slit 116 may perpendicularly penetrate through the body 130.

Figure 4A:
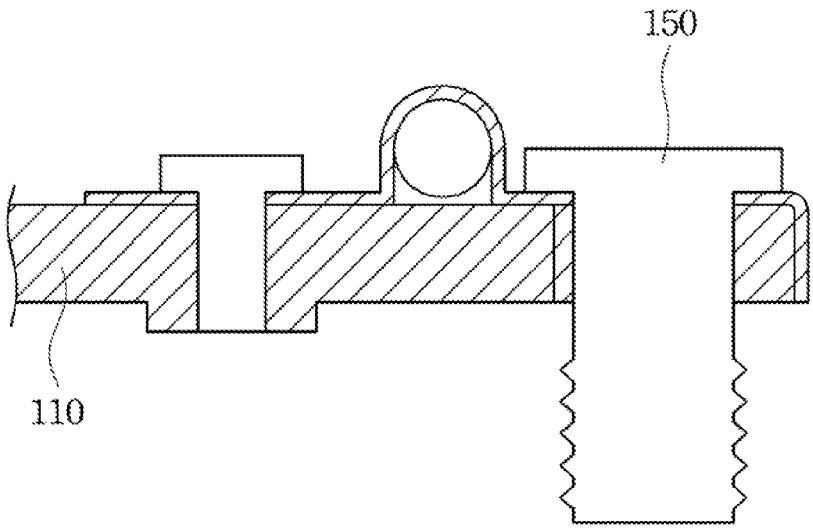
FIG. 4A is cross-sectional view showing a fastener according to one embodiment of the present disclosure.
Figure 4B:
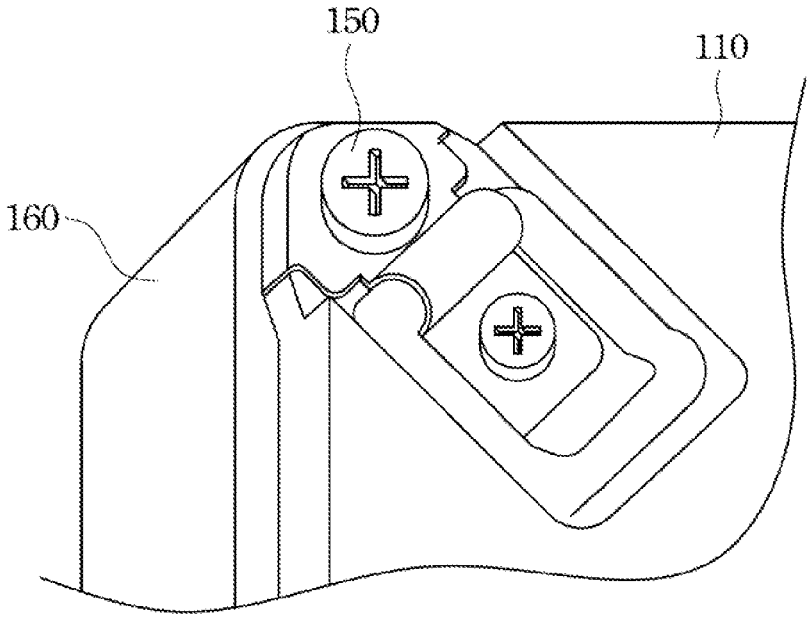
FIG. 4B is a perspective view showing a fastener securing the carrying assembly to an electronic device according to one embodiment of the present disclosure.

In another embodiment, the carrying assembly 100 may further include a fastener 150, as depicted in FIG. 1B and FIG. 4A. The fastener 150 may be disposed on at least one corner of the body 110 for the purpose of securing the carrying assembly 100 to the electronic device 160. In one example, the fastener 150 is a screw and the electronic device 160 has a corresponding screw hole, so that the screw may extend through the corner of the body 130 and secure the carrying assembly 100 to the electronic device 160, as depicted in FIG. 4B.

Figure 5:
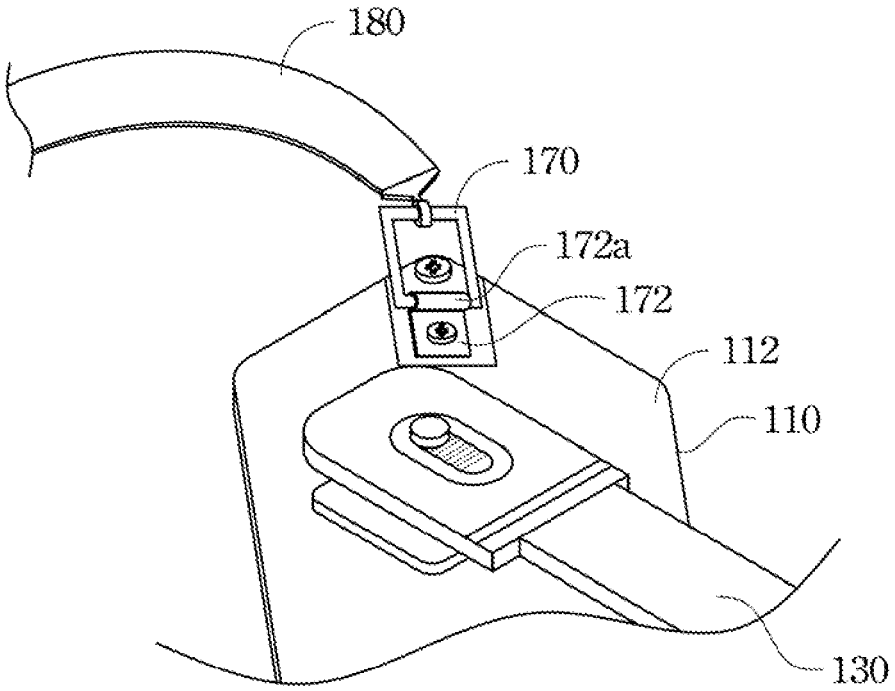
FIG. 5 is a perspective view showing a ring and a shoulder strap according to one embodiment of the present disclosure.

In still another embodiment, the carrying assembly 100 may further include a ring 170, as depicted in FIG. 5. The ring 170 is disposed on a second surface 112 of the body 110. As an example, the ring 172 may be connected to the body 130 by a fixing member 172. The fixing member 172 has a half-ring portion 172*a*, which loosely surrounds a portion of the ring 170. Accordingly, the ring 172 may be pivoted within the half-ring portion 172*a*. The ring 170 is connected to a shoulder strap 180, so that the electronic device may be carried using the shoulder strap 180.

According to another aspect of the present disclosure, an electronic device is provided. The electronic device includes the carrying assembly 100 according to any embodiment or example described hereinbefore. For instance, the electronic device may comprise the carrying assembly described above and a tablet personal computer secured thereto.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A carrying assembly for being detachably secured to a housing of an electronic device, the carrying assembly comprising:

a body including a first positioning portion and an opening, the first positioning portion being positioned on a first surface of the body;

a positioning member including a second positioning portion and a top portion connected to the second positioning portion, the second positioning portion being detachably engaged with the first positioning portion, the top portion protruding from a second surface opposite the first surface of the body through the opening, the second positioning portion being separated from the first positioning portion when the top portion is pressed, wherein the top portion is movable along the opening, so that the second positioning portion is detachably engaged with the first positioning portion at a position relative to the first positioning portion and when the top portion is pressed, the second positioning portion is separated from the first positioning portion, and capable of being moved to another position relative to the first positioning portion; and an elastic member secured on the first surface of the body, wherein the positioning member is positioned between the elastic member and the body, wherein when the top portion is pressed, the second positioning portion is separated from the first positioning portion and thus the elastic member deforms and stores an elastic potential, and when the top portion is released, the elastic member releases the elastic potential such that the second positioning portion is engaged with the first positioning portion at the another position.

2. The carrying assembly according to claim 1, wherein the elastic member comprises a fixing plate and an elastic piece, the fixing plate being secured on the first surface, one end of the elastic piece being physically connected to the fixing plate, and another end of the elastic piece abutting against the positioning member.

3. The carrying assembly according to claim 1, further comprising a belt connected to the positioning member.

4. The carrying assembly according to claim 3, wherein the body has a slit, and the belt extends from the side of the first surface through the slit to the side of the second surface.

5. The carrying assembly according to claim 1, wherein the first positioning portion is positioned in a region surrounding the opening.

6. The carrying assembly according to claim 1, wherein the first positioning portion has a first tooth structure, and the second positioning portion has a second tooth structure, the second positioning portion being detachably engaged with the first positioning portion by the first and second tooth structures.

7. The carrying assembly according to claim 1, further comprising a fastener for securing on the housing, the fastener being disposed on at least one corner of the body.

8. The carrying assembly according to claim 7, wherein the fastener comprises a ring for connecting to a shoulder strap.

9. An electronic device, comprising:

a housing; and a carrying assembly detachably secured on the housing, the carrying assembly comprising:

a body including a first positioning portion and an opening, the first positioning portion being positioned on a first surface of the body; and a positioning member including a second positioning portion and a top portion connected to the second positioning portion, the second positioning portion being detachably engaged with the first positioning portion, the top portion protruding from a second surface opposite the first surface of the body through the opening, the second positioning portion being separated from the first positioning portion when the top portion is pressed, wherein the top portion is movable along the opening, so that the second positioning portion is detachably engaged with the first positioning portion at a first position relative to the first positioning portion, and when the top portion is pressed, the second positioning portion is separated from the first positioning portion, and capable of being moved to a second position relative to the first positioning portion; and an elastic member secured on the first surface of the body, wherein the positioning member is positioned between the elastic member and the body, wherein when the top portion is pressed, the second positioning portion is separated from the first positioning portion and thus the elastic member deforms and stores an elastic potential, and when the top portion is released, the elastic member releases the elastic potential such that the second positioning portion is engaged with the first positioning portion at the second position.

10. The electronic device according to claim 9, wherein the elastic member comprises a fixing plate and an elastic piece, the fixing plate being secured on the first surface, one end of the elastic piece being physically connected to the fixing plate, and another end of the elastic piece abutting against the positioning member.

11. The electronic device according to claim 9, further comprising a belt connected to the positioning member.

12. The electronic device according to claim 11, wherein the body has a slit, and the belt extends from the side of the first surface through the slit to the side of the second surface.

13. The electronic device according to claim 9, wherein the first positioning portion is positioned in a region surrounding the opening.

14. The electronic device according to claim 9, wherein the first positioning portion has a first tooth structure, and the second positioning portion has a second tooth structure, the second positioning portion being detachably engaged with the first positioning portion by the first and second tooth structures.

15. The electronic device according to claim 9, wherein carrying assembly comprises a fastener for securing on the housing, the fastener being disposed on at least one corner of the body.

16. The electronic device according to claim 15, wherein the fastener comprises a ring for connecting to a shoulder strap.

* * * * *